US006749195B2

(12) United States Patent
Chou

(10) Patent No.: US 6,749,195 B2
(45) Date of Patent: Jun. 15, 2004

(54) STRUCTURE OF PAPER CURRENCY RECEIVING SYSTEM FOR TICKET VENDING MACHINE OR THE LIKE

(75) Inventor: Shang-Ter Chou, Taoyuan (TW)

(73) Assignee: International Currency Technologies Corp., Taipei (TW)

( * ) Notice: Subject to any disclaimer, the term of this patent is extended or adjusted under 35 U.S.C. 154(b) by 173 days.

(21) Appl. No.: 10/035,126

(22) Filed: Jan. 4, 2002

(65) Prior Publication Data

US 2003/0127790 A1 Jul. 10, 2003

(51) Int. Cl.[7] ..... B65H 29/46
(52) U.S. Cl. ..... 271/181; 194/350
(58) Field of Search ..... 194/206, 207, 194/350; 271/181, 180, 177; 221/198, 4; 209/534; 902/12, 13

(56) References Cited

U.S. PATENT DOCUMENTS 4,980,543 A * 12/1990 Hara et al. ..... 235/379
5,641,157 A * 6/1997 Mays et al. ..... 271/181
5,709,525 A * 1/1998 Marzullo et al. ..... 414/798.7
5,836,435 A * 11/1998 Fujita et al. ..... 194/206

* cited by examiner

*Primary Examiner*—F. J. Bartuska
(74) *Attorney, Agent, or Firm*—Bacon & Thomas, PLLC

(57) ABSTRACT

A paper currency receiving system is constructed to include a paper currency take-up unit adapted for taking up paper currency inserted therein, a paper currency storage cabinet mounted in the paper currency take-up unit to collect paper currency, a paper currency holding down mechanism installed in the paper currency take-up unit and controlled to hold down inserted paper currency onto a spring-supported bearing plate in the paper currency storage cabinet, the paper currency holding down mechanism including a rack set driven by a motor through a transmission gear train to move a linkage in an out of the paper currency storage cabinet for setting collected paper currency in a stack, and a transmitter receiver module, which automatically cuts off power supply when a predetermined amount of paper currency collected in the paper currency storage cabinet.

4 Claims, 11 Drawing Sheets

STRUCTURE OF PAPER CURRENCY RECEIVING SYSTEM FOR TICKET VENDING MACHINE OR THE LIKE

BACKGROUND OF THE INVENTION

1. Field of the Invention

The present invention relates to a paper currency receiving system for use in a ticket vending machine, money exchange machine, or the like and, more particularly to such a paper currency receiving system, which comprises a paper currency take-up unit, a paper currency storage cabinet installed in the paper currency take-up unit, a motor-driven paper currency holding down mechanism installed in the paper currency take-up unit controlled to set collected paper currency in a stack inside the paper currency storage cabinet, and a transmitter receiver module adapted to detect the amount of collected paper currency.

2. Description of the Related Art

A variety of ticket vending machines have been disclosed, and intensively used in parking lots, stations, public facilities for receiving paper currency and vending tickets. FIGS. 9, 10, and 11 show a paper currency receiving system used in a conventional ticket vending machine. The paper currency receiving system is generally comprised of a paper currency take-up unit adapted for taking up inserted paper currency, the paper currency take-up unit having a paper currency insertion slot and a paper currency transferring mechanism, a paper currency verification unit adapted for verifying the authenticity of inserted paper currency, and a paper currency storage cabinet adapted for collecting verified paper currency. When paper currency inserted through the paper currency insertion slot to the paper currency transferring mechanism in the paper currency take-up unit, the paper currency verification unit verify the authenticity of received paper currency. When verified, the paper currency transferring mechanism is started to transfer accepted paper currency to a paper currency holding down mechanism in the paper currency take-up unit. The paper currency holding down mechanism uses a motor to rotate an eccentric block, causing the eccentric block to move a follower plate into the paper currency storage cabinet to hold down received paper currency. This design of paper currency holding down mechanism is still not satisfactory in function. Due to limited contact area between the eccentric block and the follower plate, the follower plate may not be kept in balance when moved, thereby causing the received piece of paper currency to be wrinkled or jammed. Because much torsional force is needed to drive the eccentric block to move the follower plate, the motor bears much load during its operation, resulting in short service life. Further, this design of paper currency receiving system has no means to detect the amount of received paper currency. The worker must regularly visually check the paper currency storage cabinet to see if the paper currency storage cabinet has been in full or not. It is inconvenient to check the paper currency storage condition of the paper currency storage cabinet visually.

SUMMARY OF THE INVENTION

The present invention has been accomplished to provide a paper currency receiving system, which eliminates the aforesaid drawbacks. According to one aspect of the present invention, the paper currency receiving system comprises a paper currency take-up unit adapted for taking up paper currency inserted therein, a paper currency storage cabinet mounted in the paper currency take-up unit to collect paper currency, and a paper currency holding down mechanism installed in the paper currency take-up unit and controlled to hold down inserted paper currency onto a spring-supported bearing plate in the paper currency storage cabinet. According to another aspect of the present invention, the paper currency holding down mechanism comprises a motor, a transmission gear train, a linkage, and a rack set driven by the motor through the transmission gear train to move the linkage in an out of the paper currency storage cabinet for setting collected paper currency in a stack. According to still another aspect of the present invention, a transmitter receiver module is provided inside the paper currency storage cabinet to detect the amount of collected paper currency and, to automatically cut off power supply when a predetermined amount of paper currency collected in the paper currency storage cabinet.

DETAILED DESCRIPTION OF THE PREFERRED EMBODIMENT

Figure 1:
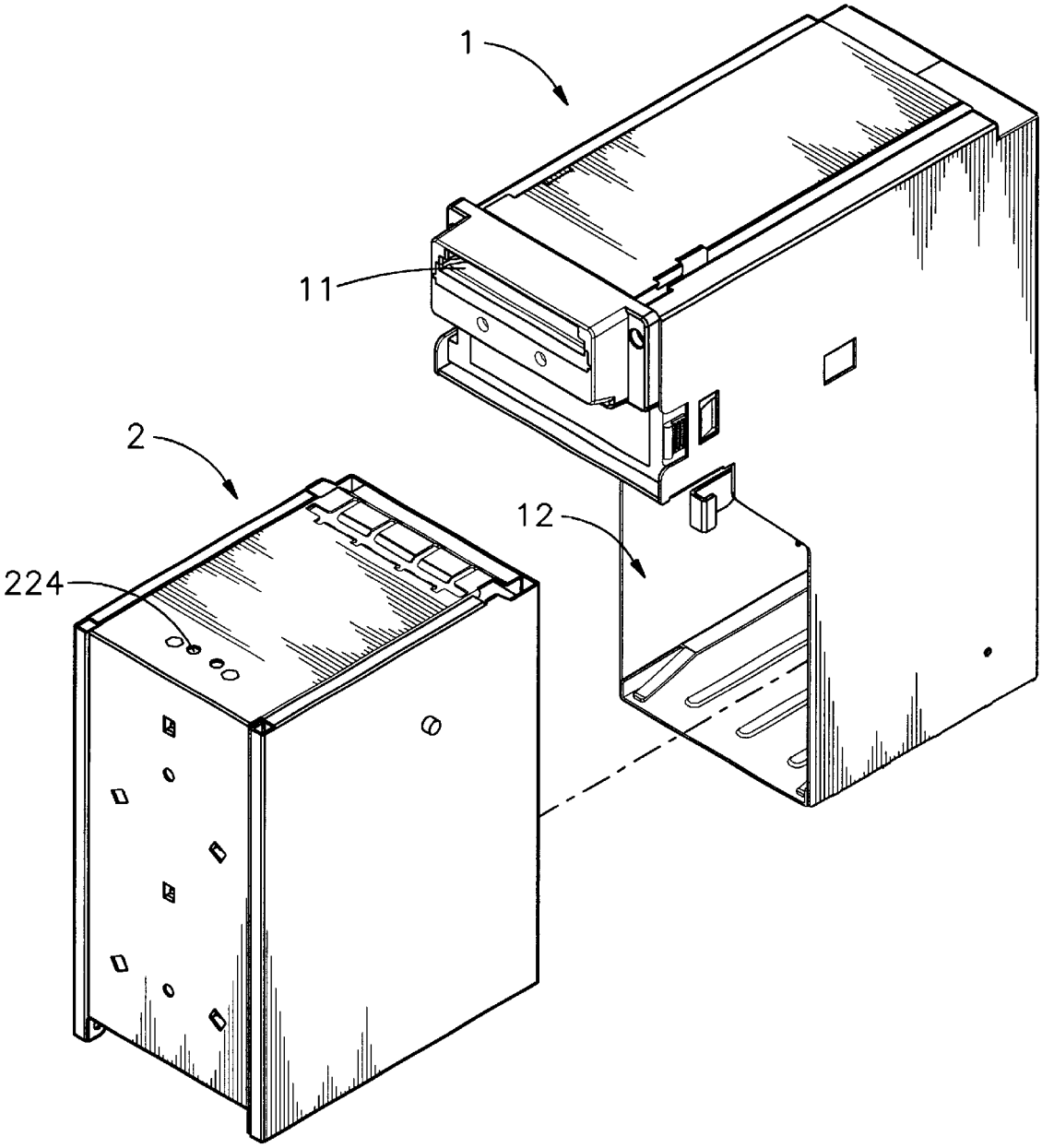
FIG. 1 is an exploded view of a paper currency receiving system according to the present invention.

Referring to FIGS. from 1 through 4, a paper currency receiving system in accordance with the present invention is generally comprised of a paper currency take-up unit 1, and a paper currency storage cabinet 2. The paper currency storage cabinet 2 is fastened to the backside of the paper currency take-up unit 1.

The paper currency take-up unit 1 comprises a paper currency insertion slot 11 horizontally disposed at an upper side, a receiving chamber 12 disposed at a lower side and adapted for receiving the paper currency storage cabinet 2, a paper currency transferring mechanism (not shown) adapted for transferring inserted paper currency from the paper currency insertion slot 11 to the paper currency storage cabinet 2 in the receiving chamber 12, and a paper currency holding down mechanism 13 controlled to hold down paper currency in the paper currency storage cabinet 2. The paper currency holding down mechanism 13 comprises a motor 131, a transmission gear train 132, two racks 133 meshed with the transmission gear train 132, a linkage 14 coupled to one rack 133. The linkage 14 comprises a flat base frame 141, the base frame 141 having two longitudinal sliding slots 1411 bilaterally aligned near one end and two pivot holes 1412 bilaterally aligned near the other end, a follower plate 143 arranged in parallel to the base frame 141, the follower plate 143 having two longitudinal sliding slots 1431 bilaterally aligned near one end and two pivot holes 1432 bilaterally aligned near the other end, a crossed link 142, and four transverse rods 144 respectively provided at the four ends of the crossed link 142 and pivoted to the longitudinal sliding slots 1411 and pivot holes 1412 of the flat base frame 141 and the longitudinal sliding slots 1431 and pivot holes 1432 of the follower plate 143. One transverse rod 144 is transversely connected to one rack 133. A return spring 1331 is connected one rack 133 and the flat base frame 141 of the linkage 14. When operating the motor 131 to rotate the transmission gear train 132 in one direction, the racks 133 are extended out, and the crossed link 142 is lifted to move the follower plate 143 outwards from the flat base frame 141. On the contrary, when operating the motor 131 to rotate the transmission gear train 132 in the reversed direction, the racks 133 are received, and the crossed link 142 is lowered to move the follower plate 143 backward toward the flat base frame 141.

The paper currency storage cabinet 2 comprises stop flanges 21 around the front open side thereof, two through holes 224 through the top panel thereof, a transmitter receiver module 22 fixedly provided at the bottom side of the top panel remote from the front open side, two conical springs 24 mounted on the inside, and a bearing plate 23 supported on the conical springs 24 and facing the follower plate 143 of the linkage 14 of the paper currency holding down mechanism 13. The transmitter receiver module 22 comprises a transmitter 222 and a receiver 223 bilaterally disposed at the top corresponding to the through holes 224, and a middle bottom passage 221. The bearing plate 23 comprises two coupling grooves 241 respectively coupled to the conical springs 24, and a protruding block 231 corresponding to the middle bottom passage 221 of the transmitter receiver module 22.

Referring to FIGS. from 5 through 8, when a piece of paper currency inserted into the paper currency insertion slot 11 of the paper currency take-up unit 1, the paper currency transferring mechanism of the paper currency take-up unit 1 immediately transfers the inserted piece of paper currency from the paper currency insertion slot 11 to the gap between the follower plate 143 of the paper currency holding down mechanism 13 and the bearing plate 23 of the paper currency storage cabinet 2, and then the motor 131 is started to rotate the transmission gear train 132 in one direction and to extend out the racks 133, thereby causing the racks 133 to lift the crossed link 142 of the linkage 14 and to move the follower plate 143 outwards from the flat base frame 141 to the inserted piece of paper currency against the bearing plate 23. Thereafter, the motor 131 is reversed to rotate the transmission gear train 132 in the reversed direction and to receive the racks 133, thereby causing the racks 133 to lower the crossed link 142 of the linkage 14 and to move the follower plate 143 backwards from the bearing plate 23 to the flat base frame 141. At this time, the conical springs 24 immediately force the bearing plate 23 outward, keeping the received piece of paper currency jammed in between the bearing plate 23 and the stop flanges 21 of the paper currency storage cabinet 2. When the paper currency storage cabinet 2 filled up with paper currency, the bearing plate 23 is moved to the position where the protruding block 231 is forced into the passage 221 of the transmitter receiver module 22 to block light passage between the transmitter 222 and the receiver 223. At this time, the receiver 223 receives no signal from the transmitter 222, thereby causing the transmitter receiver module 22 to cut off power supply from the paper currency take-up unit 1.

Figure 2:
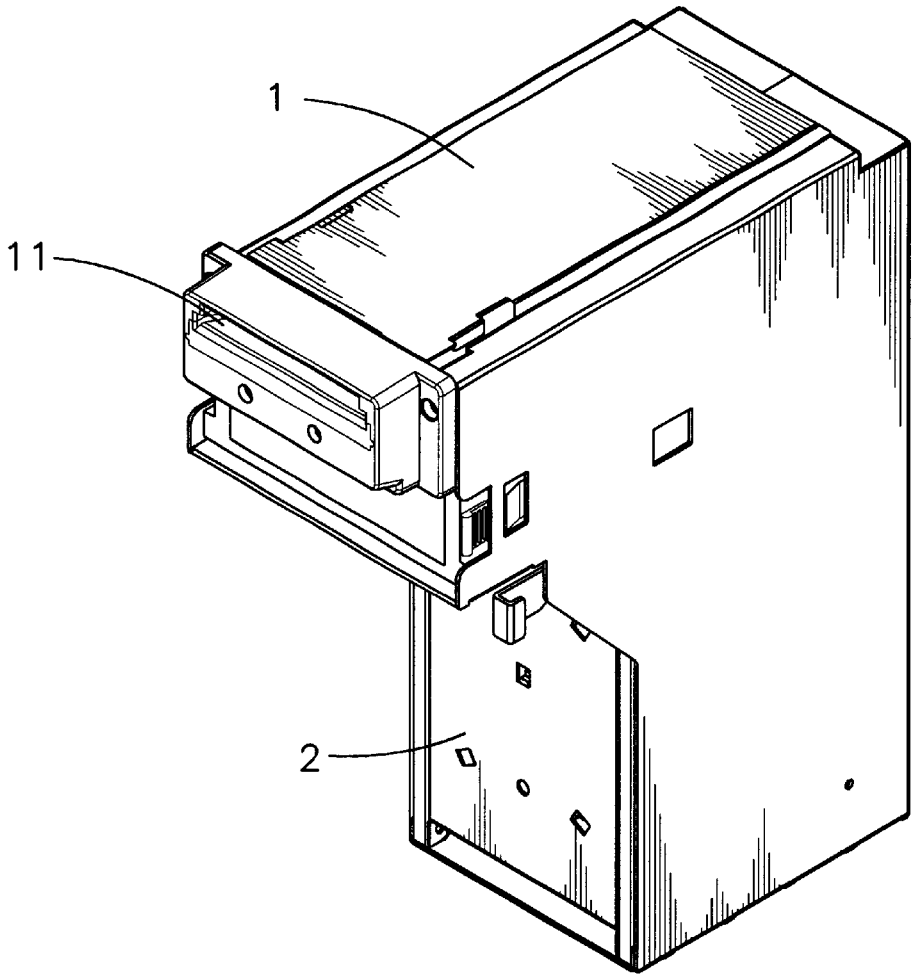
FIG. 2 is an assembly view of the paper currency receiving system shown in FIG. 1.
Figure 3:
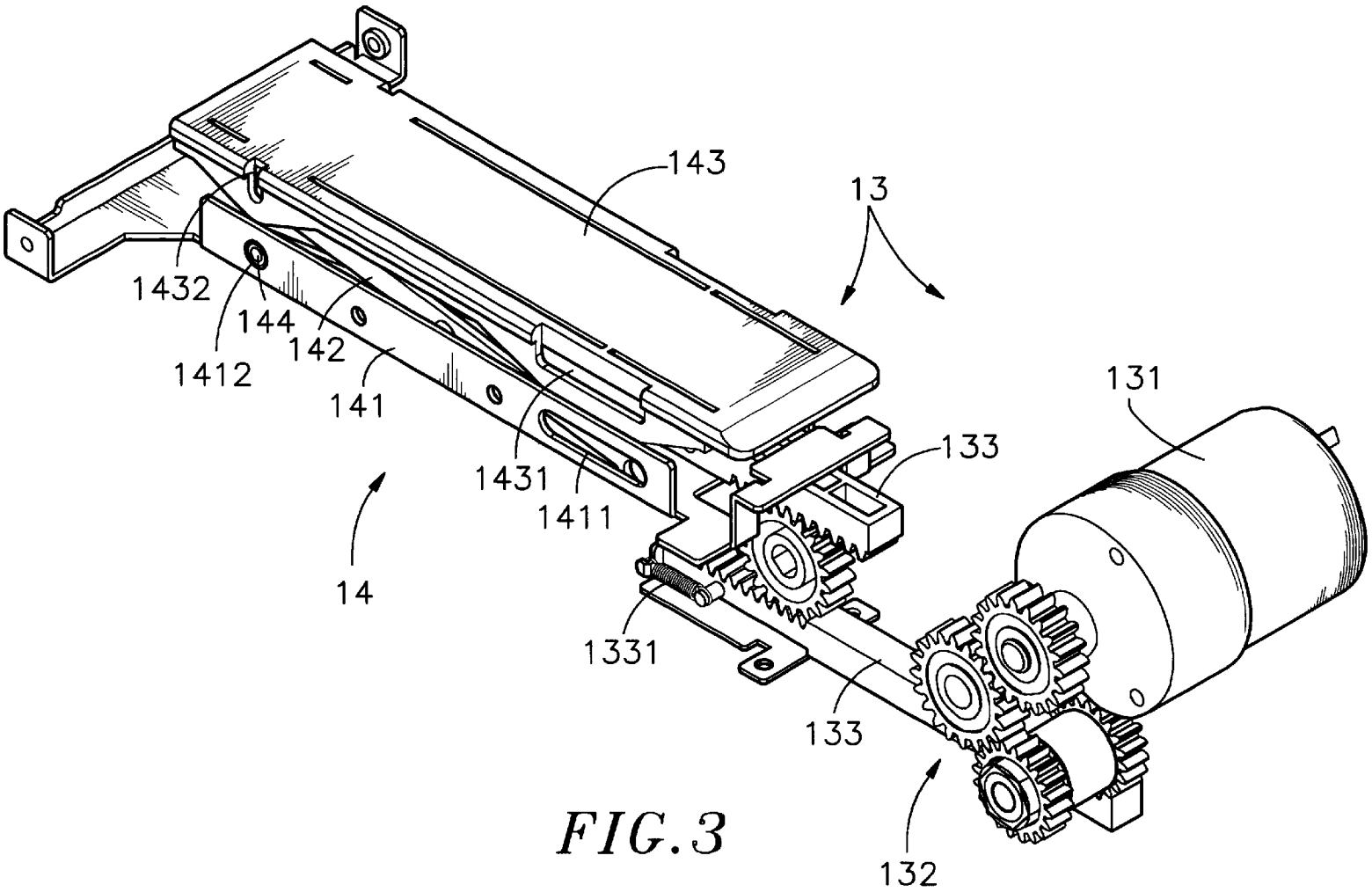
FIG. 3 is a perspective view of the paper currency holding down mechanism for the paper currency receiving system according to the present invention.
Figure 4:
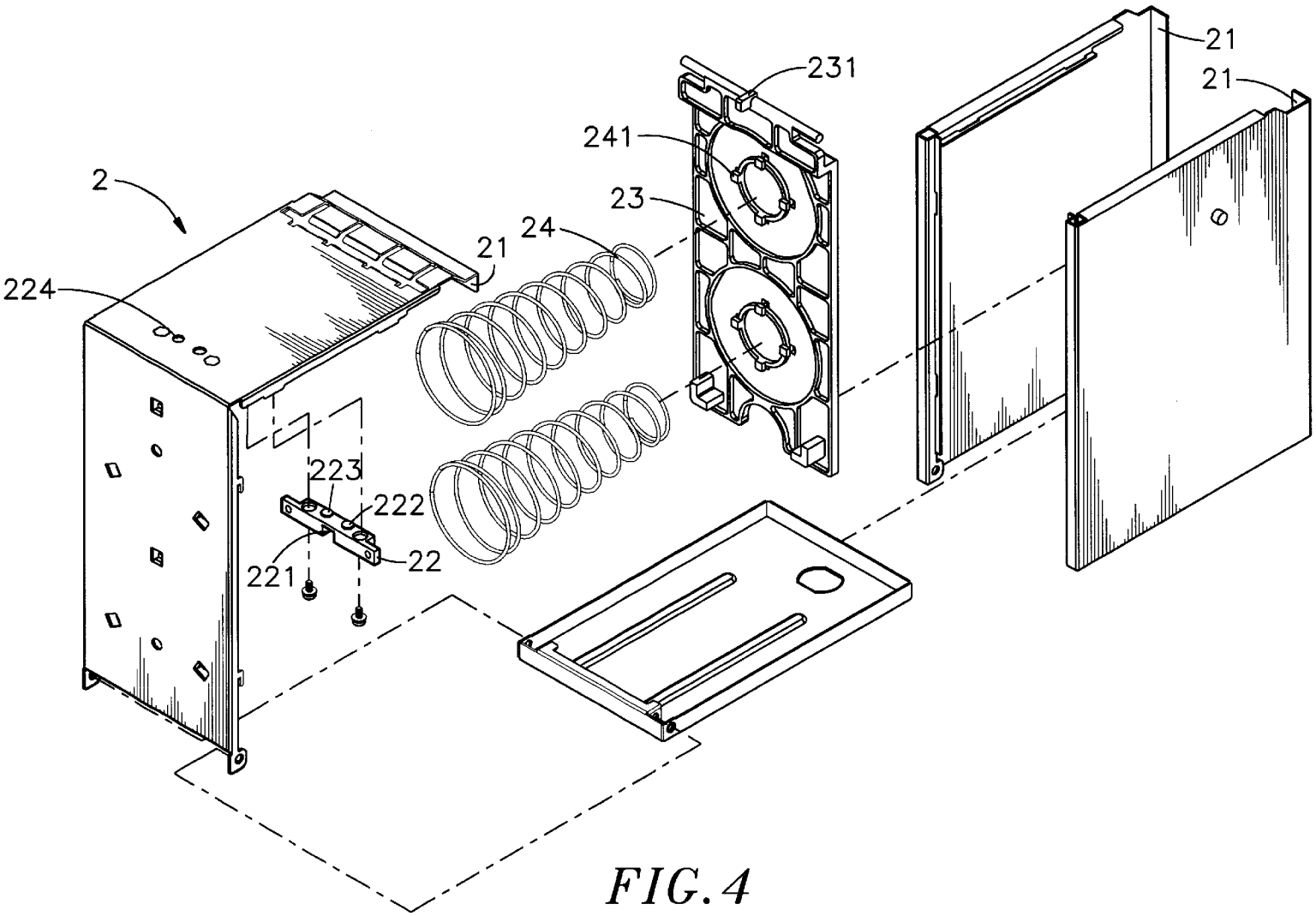
FIG. 4 is an exploded view of the paper currency storage cabinet for the paper currency receiving system according to the present invention.
Figure 5:
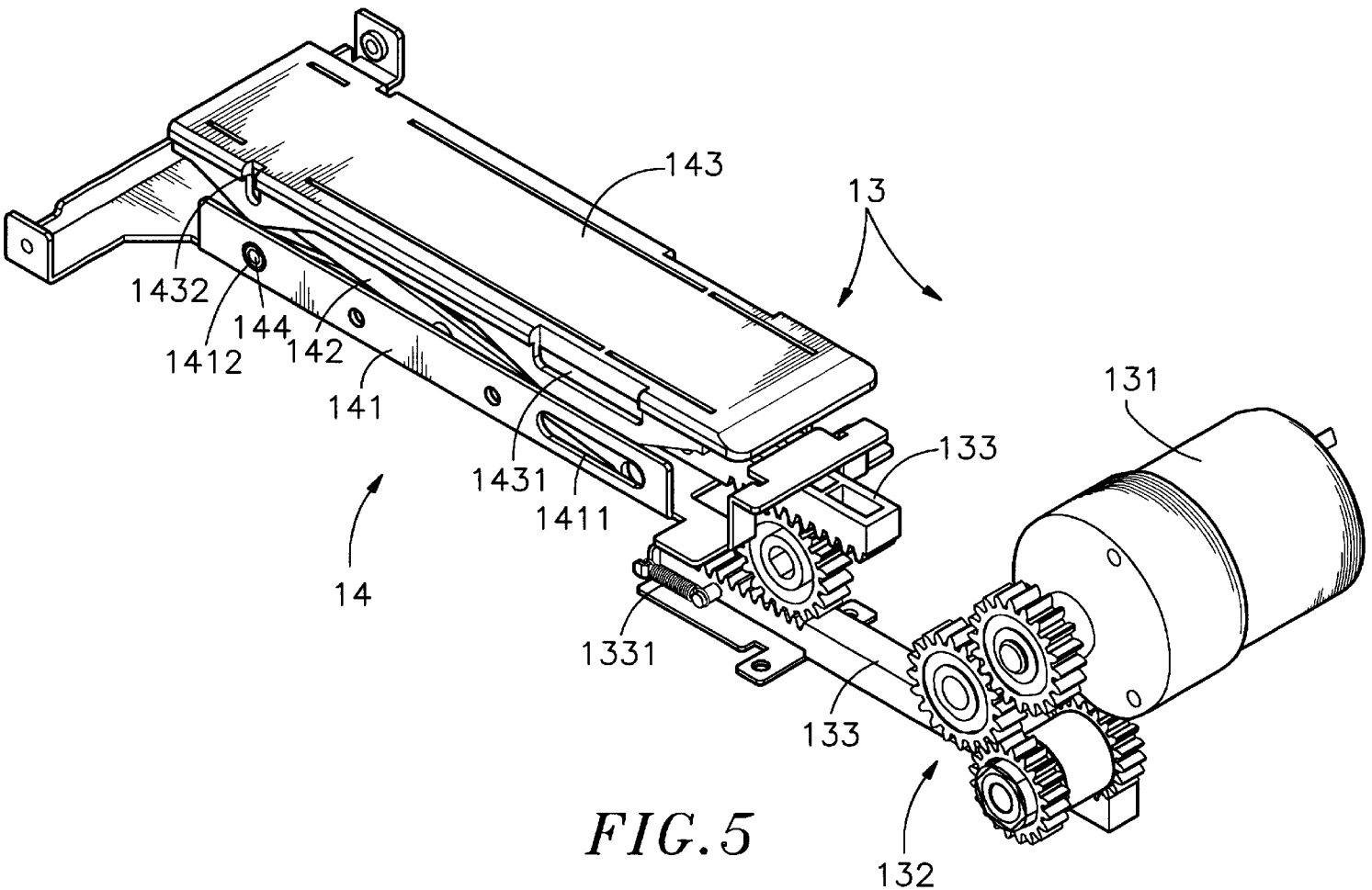
FIG. 5 is a perspective view showing the received status of the paper currency holding down mechanism according to the present invention.
Figure 6:
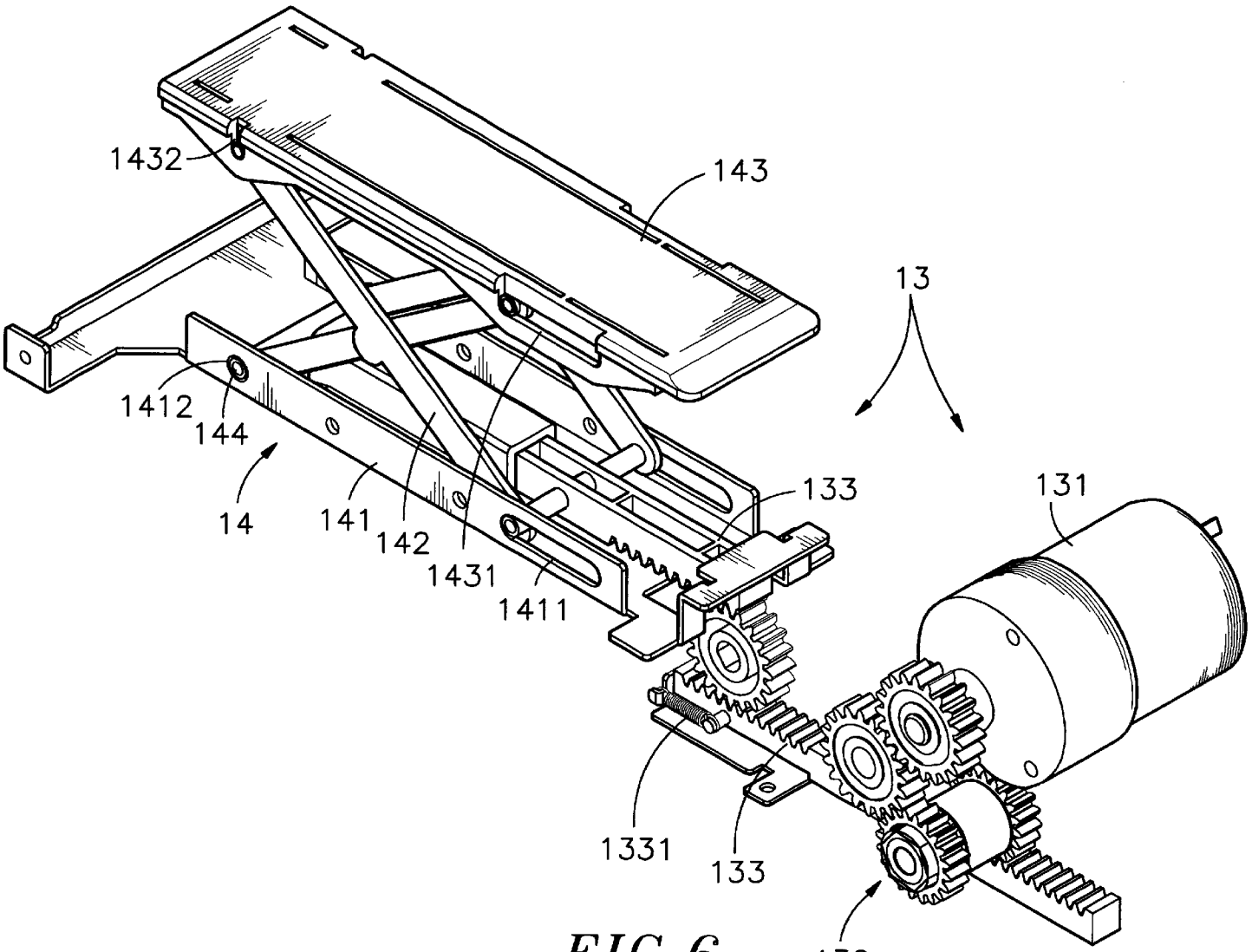
FIG. 6 is a perspective view showing the extended status of the paper currency holding down mechanism according to the present invention.
Figure 7:
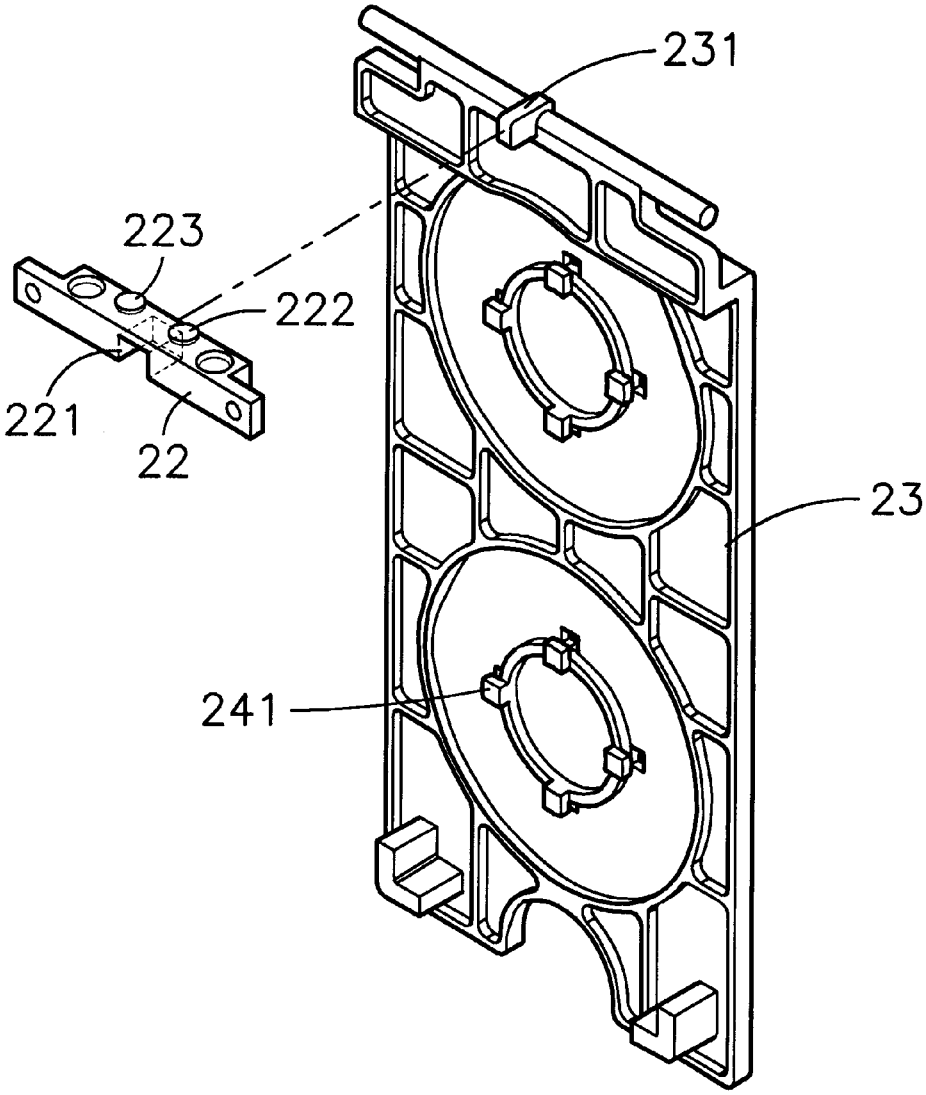
FIG. 7 is a perspective view of a part of the present invention showing the protruding block of the bearing plate spaced from the transmitter receiver module.
Figure 8:
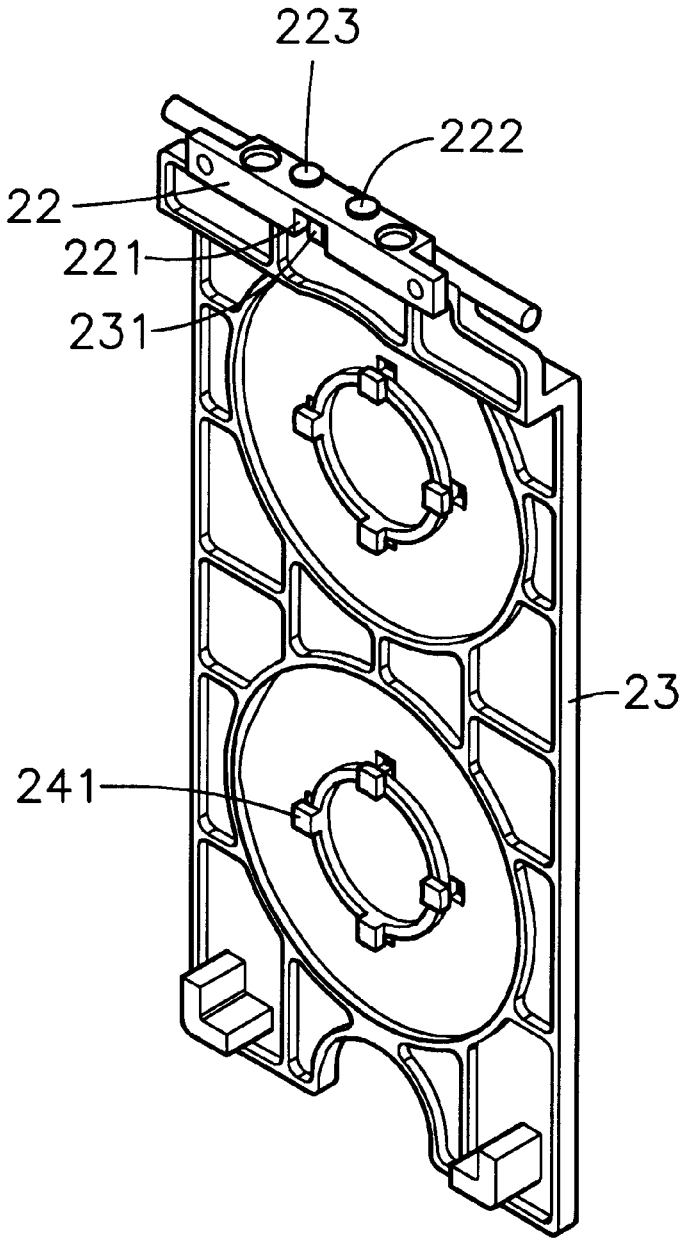
FIG. 8 is a perspective view of a part of the present invention showing the protruding block of the bearing plate engaged into the middle bottom passage of the transmitter receiver module.
Figure 9:
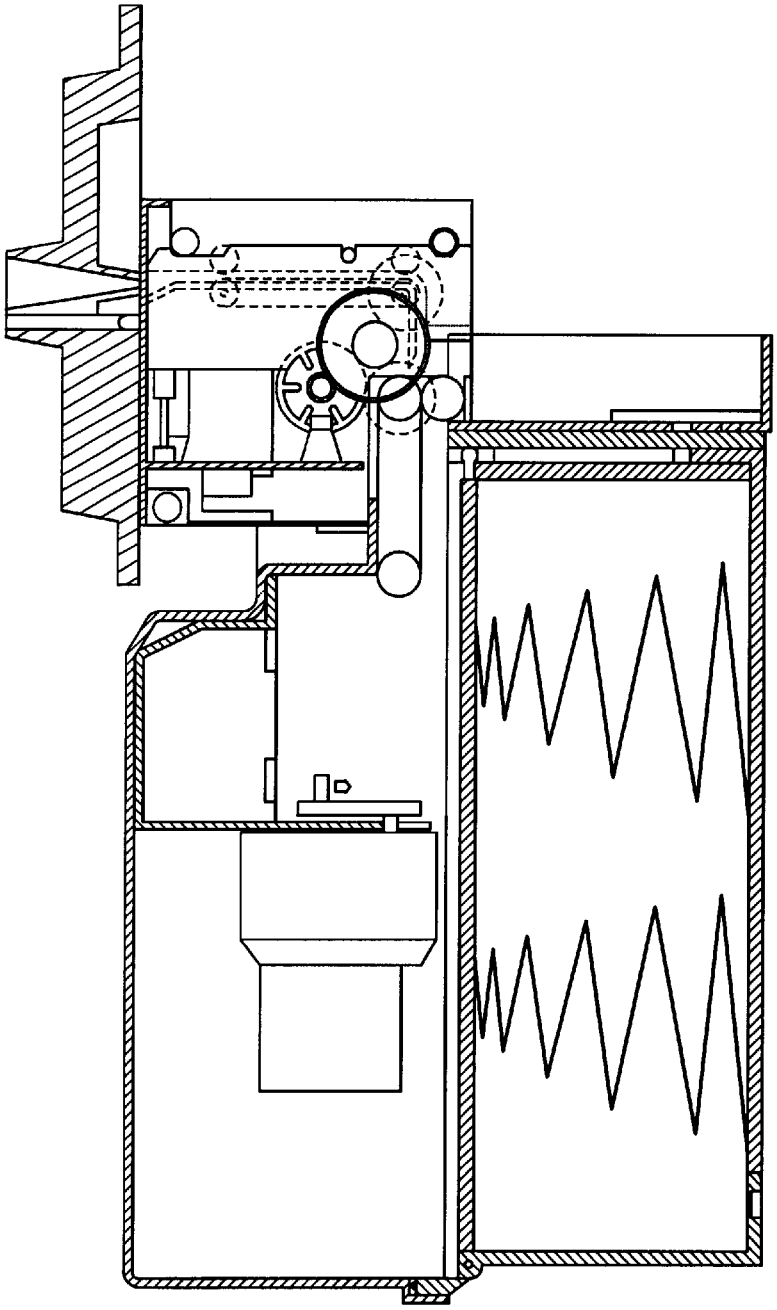
PRIOR ART FIG. 9
FIG. 9 is a side view in section of a paper currency receiving system constructed according to the prior art.
Figure 10:
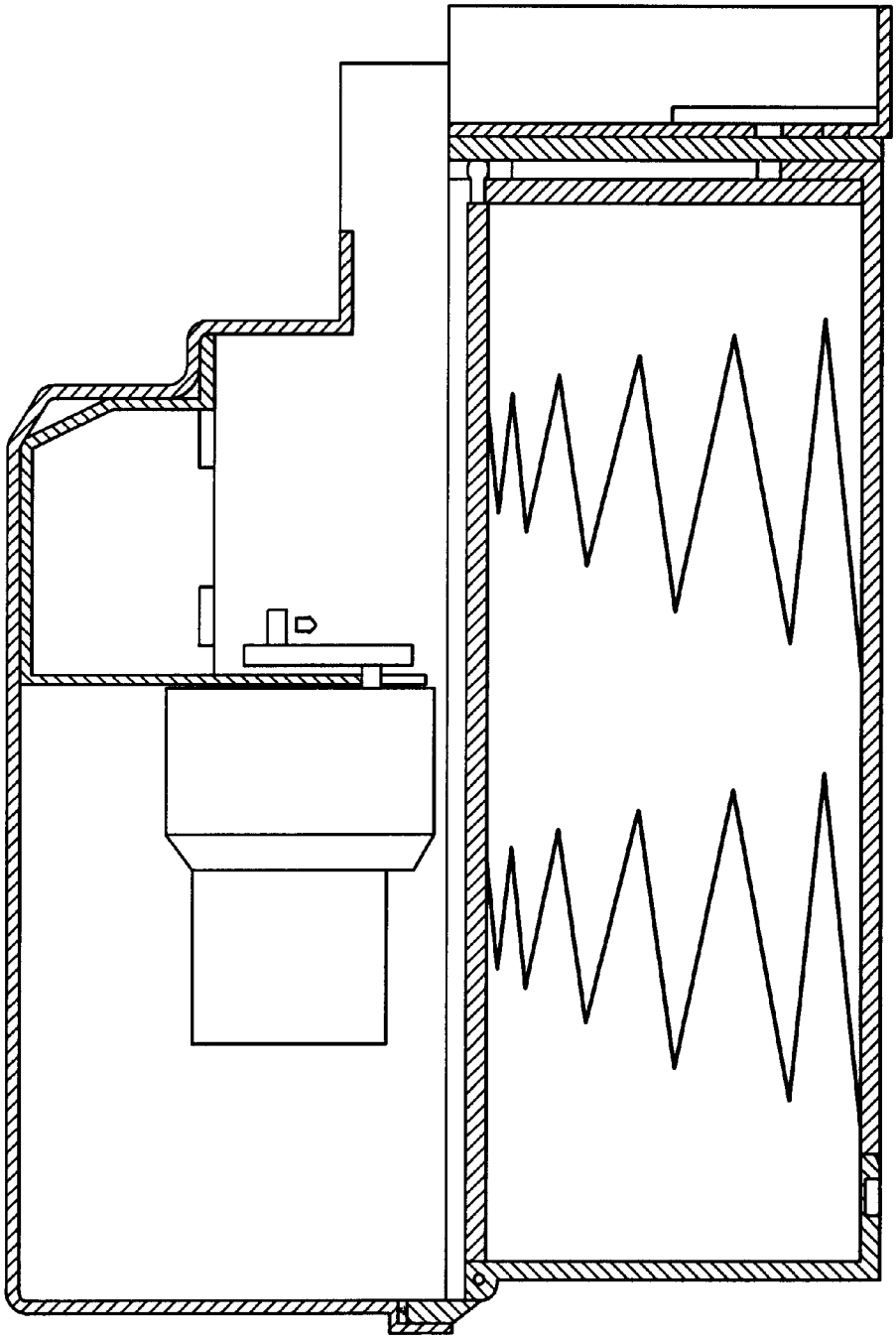
PRIOR ART FIG. 10
FIG. 10 is an enlarged view of a part of FIG. 9.
Figure 11:
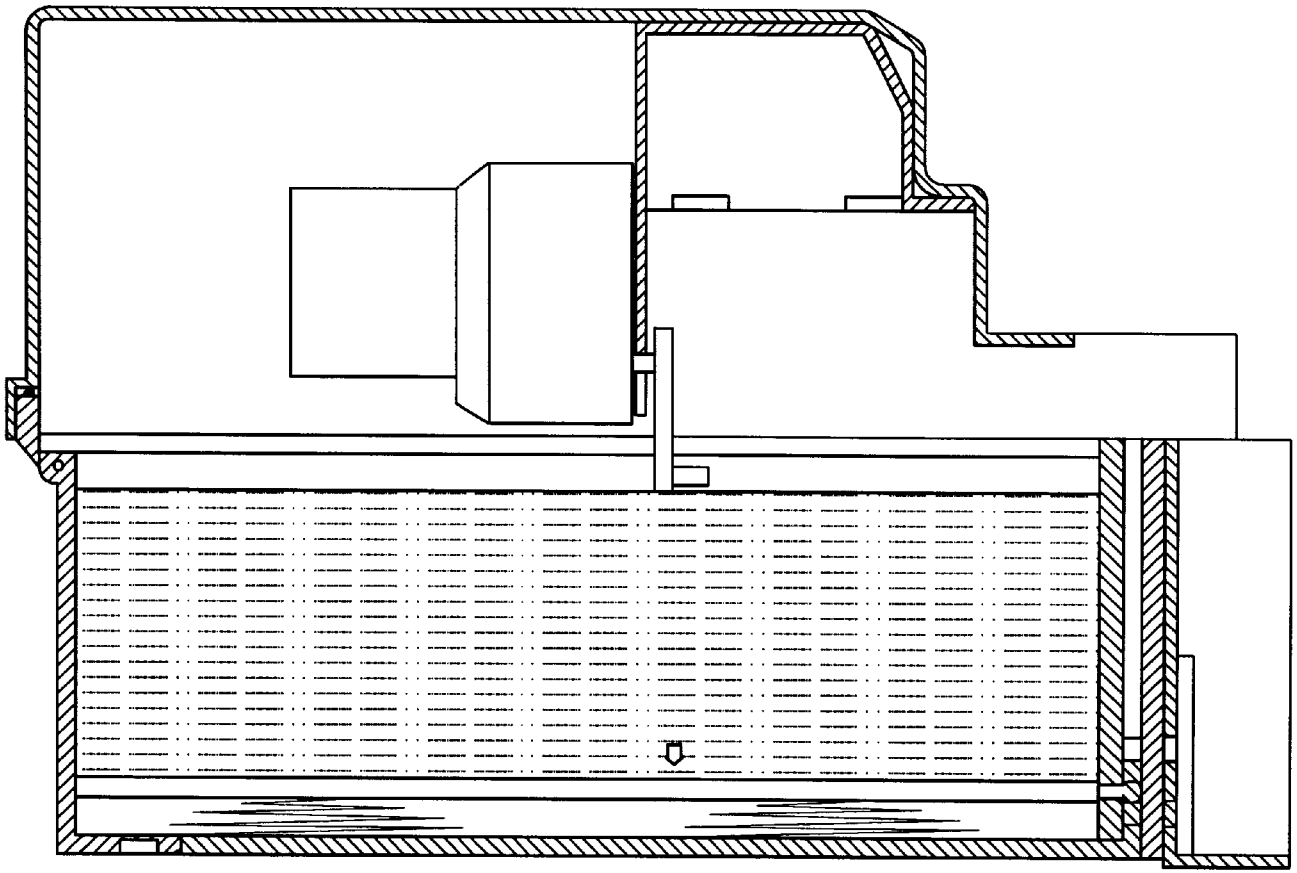
PRIOR ART FIG. 11
FIG. 11 is similar to FIG. 10 but showing a stack of paper currency received in the paper currency storage cabinet.

A prototype of paper currency receiving system has been constructed with the features of the annexed drawings of FIGS. 1–8. The paper currency receiving system functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A paper currency receiving system comprising a paper currency take-up unit, and a paper currency storage cabinet mounted in said paper currency take-up unit to collect paper currency inserted into said paper currency take-up unit, said paper currency storage cabinet comprising a front open side adapted for receiving paper currency transferred from a paper currency transferring mechanism, a plurality of conical springs, stop flanges, and a bearing plate supported on said conical springs and adapted for holding down received paper currency on said stop flanges, said paper currency take-up unit comprising a paper currency insertion slot, said paper currency transferring mechanism being adapted to transfer inserted paper currency from said paper currency insertion slot to the front open side of said paper currency storage cabinet, and a paper currency holding down mechanism controlled to hold down paper currency transferred from said paper currency transferring mechanism onto the bearing plate of said paper currency storage cabinet, wherein said paper currency holding down mechanism comprises a motor, a transmission gear train coupled to said motor, a rack set meshed with said transmission gear train, and a linkage coupled to said rack set and moved in and out of the front open side of said paper currency relative to the bearing plate of said paper currency storage cabinet, wherein said linkage of said paper currency holding down mechanism comprises a flat base frame, a follower plate facing said bearing plate of said paper currency storage cabinet, and a crossed link coupled between said flat base frame and said follower plate and connected to said rack set for moving said follower plate relative to said flat base frame upon movement of said rack set, and wherein said linkage further comprises return spring means connected between said flat base frame and said rack set.

2. The paper currency receiving system as claimed in claim 1, wherein said flat base frame and said follower plate each have two pivot holes bilaterally aligned near one end and two longitudinal sliding slots bilaterally aligned near an opposite end; said crossed link has four transverse rods fixedly provided at four ends thereof and respectively coupled to the pivot holes and longitudinal sliding slots of said flat base frame and said follower plate.

3. A paper currency receiving system comprising a paper currency take-up unit, and a paper currency storage cabinet mounted in said paper currency take-up unit to collect paper currency inserted into said paper currency take-up unit, said paper currency storage cabinet comprising a front open side adapted for receiving paper currency transferred from a paper currency transferring mechanism, a plurality of conical springs, stop flanges, and a bearing plate supported on said conical springs and adapted for holding down received paper currency on said stop flanges, said paper currency take-up unit comprising a paper currency insertion slot, said paper currency transferring mechanism being adapted to transfer inserted paper currency from said paper currency insertion slot to the front open side of said paper currency storage cabinet, and a paper currency holding down mechanism controlled to hold won paper currency transferred from said paper currency transferring mechanism onto the bearing plate of said paper currency storage cabinet, wherein said paper currency holding down mechanism comprises a motor, a transmission gear train coupled to said motor, a rack set meshed with said transmission gear train, and a linkage coupled to said rack set and moved in and out of the front open side of said paper currency relative to the bearing plate of said paper currency storage cabinet, wherein said paper currency storage cabinet comprises a plurality of stop flanges disposed around said front open side and adapted for stopping collected paper currency inside said paper currency storage cabinet after movement of said follower plate out of the front open side of said paper currency storage cabinet, two through holes through a top panel thereof, and a transmitter receiver module fixedly provided at a bottom side of said top panel corresponding to the through holes in said top panel and adapted to detect the amount of paper currency collected in said paper currency storage cabinet.

4. The paper currency receiving system as claimed in claim 3, wherein said transmitter receiver module comprises a transmitter aimed at one of the through holes in the top panel of said paper currency storage cabinet, a receiver aimed at the other through hole in the top panel of said paper currency storage cabinet, and a transversely extended bottom passage between said transmitter and said receiver; said bearing plate comprises a protruding block, which is moved with said bearing plate into the bottom passage of said transmitter receiver module to block a signal path between said transmitter and said receiver when a predetermined amount of paper currency is collected in said paper currency storage cabinet.

* * * * *